United States Patent [19]

Ballman

[11] 4,425,486

[45] Jan. 10, 1984

[54] ELECTRICAL RECEPTACLE AND SWITCH

[76] Inventor: Gray C. Ballman, 30 Portland Dr., Frontenac, Mo. 63131

[21] Appl. No.: 392,149

[22] Filed: Jun. 25, 1982

[51] Int. Cl.[3] ..... H01R 33/30

[52] U.S. Cl. ..... 200/51 R; 200/51.09; 200/153 T

[58] Field of Search ..... 200/51.09, 51 R, 51.10, 200/153 T, 260, 261

[56] References Cited

U.S. PATENT DOCUMENTS

| | | | |
|---|---|---|---|
| 2,531,625 | 11/1950 | Hubbell | 200/51.09 |
| 2,540,496 | 2/1951 | Sperrazza | 200/51.09 |
| 3,149,211 | 9/1964 | Stuart | 200/51.09 |
| 3,786,502 | 1/1974 | Stendig et al. | 200/51.09 X |

FOREIGN PATENT DOCUMENTS

| | | | |
|---|---|---|---|
| 1129581 | 5/1962 | Fed. Rep. of Germany | 200/51.09 |

*Primary Examiner*—John W. Shepperd
*Assistant Examiner*—Renee Kidorf
*Attorney, Agent, or Firm*—Rogers, Eilers & Howell

[57] ABSTRACT

An electrical receptacle has a stationary terminal bracket at each blade opening and a spring loaded center contact pressure element which deflects as the blades of a plug are inserted. A push button snap switch is mounted to the back of the receptacle and is operated by the contact pressure element as a plug is inserted or removed from the receptacle. The spring loaded biasing of the center cntact pressure element is non-conductive and isolated from the electrical circuit of the receptacle.

9 Claims, 7 Drawing Figures

ELECTRICAL RECEPTACLE AND SWITCH

BACKGROUND AND SUMMARY

There are many designs of electrical plug outlets or receptacles for receiving a blade type electrical plug connector. A common example of this type of device is the wall outlet found in any home and used to furnish a simple and convenient connection for an electrical appliance or the like. In many receptacles, the blades of the plug make connection upon insertion by spreading the spring clip jaws of the electricl connector. The spring tension of the electrical connector itself provides the contact pressure for maintaining the blade in sufficient contact therewith to ensure a good, safe electrical connection. However, as the spring clip jaws of the female connector providing the spring tension form part of the current path through the receptacle, they are subject to heating and constant flexing through insertion and removal of the plug. This has a tendency to diminish the spring tension and hence the contact pressure as the receptacle is used. As the contact pressure diminishes, the resistance between the blade and the connector increases which further increases the heating and loss of spring tension in the connection.

In low voltage applications, it is even more important to have good contact pressure as a small voltage drop can interfere with circuit operation. For instance, in a 12 volt circuit, a loss of 2 or 3 volts can seriously affect the operation of a battery charger which must generally maintain an applied voltage higher than the rated battery voltage during charging. Thus, it becomes increasingly important to ensure a relatively higher level of contact pressure and if possible to isolate the current carrying members of the connector from the portion of the connector providing the contact pressure. Also, in lower voltage applications, it is desirable to provide a "wiping" action as the plug is inserted in the receptacle. This helps clean the contact surfaces upon each insertion and removal to ensure a good electrical connection therebetween. Still another desirable feature of a low voltage receptacle and plug-in connector is that the blades be self seating within the receptacle. It would be undesirable from an operational standpoint to require that the plug to be precisely inserted in a certain orientation or manner other than to the extent required to align the blades with the holes in the receptacle. Any human operator of the device would expect this from his common ordinary experience, and a good design should accommodate this expectation.

It is also desirable in many applications to disconnect or connect a separate circuit if a plug is inserted into the receptable. For instance in a battery charging circuit it is desirable to disable the operation of the device upon insertion of a plug providing power to the batteries contained within the device. This would prevent a machine operator from attempting to operate the machine while the battery charger is connected.

Another requirement of a receptacle of this nature is that it be relatively low cost and, if possible, capable of being manufactured through low cost methods such as injection molding. Once manufactured, any assembly should be kept to a minimum, with the possible exception of having the capability of renewing the electrical contact surfaces of the receptacle in a convenient manner.

A receptacle providing the many advantages and benefits described above has been invented as is disclosed and claimed herein. The receptacle includes a face having a pair of blade openings canted for a standard D-C plug-in and arranged for flush mounting. A back body member may be integrally molded with the face and has slots for the installation of bracket-type terminals. A contact pressure element is generally wedge shaped, is spring loaded from the back body member, and has flattened surfaces which rest against the terminals. The body member has a center guide platform extending between the blade openings, the contact pressure element having a center guide notch to match and line up with the guide platform and ride therealong as the blades of a plug are inserted through the blade openings. This helps to center the blades upon insertion. A push button snap switch is mounted beneath the contact pressure element with its push button operator aligned with the post extending through the contact pressure element and the back body such that as the blades are inserted into the receptacle, they push against the flattened surfaces of the contact pressure element and bring the head of the post against the push button operator to actuate the snap switch. The pressure of the spring can be adjusted to vary the contact pressure between the blade and the terminal, and also provides the wiping action as the blade is inserted.

Thus, the receptacle of the present invention provides a high contact pressure especially suited for low voltage applications with a wiping action between the blades and terminals during each insertion or removal thereof, and which isolates the spring member from the electrical circuit such that the tension of the spring is not affected through heating. The novel contact pressure element serves the dual purpose of providing a self centering surface which forces the blades against the terminals, and which carries the post or stem member of the spring loaded mechanism against the push button snap switch to actuate same as the blades of the plug are inserted or removed. These and other beneficial features of the invention are more fully explained in the drawings and the following description of the preferred embodiment.

DETAILED DESCRIPTION OF THE PREFERRED EMBODIMENT

Figure 5:
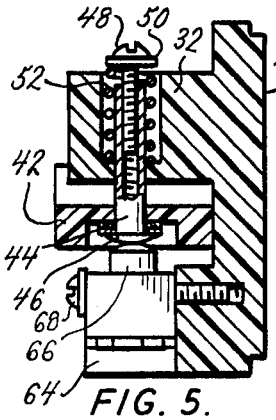
FIG. 5 is a cross-sectional view taken along the plane of line 5—5 in FIG. 4 which details the post and spring biasing mechanism for the contact pressure element.
Figure 7:
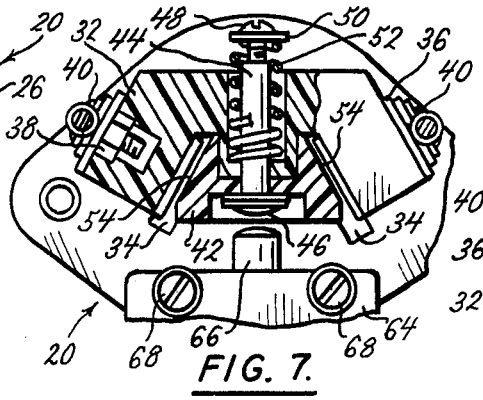
FIG. 7 is a rear view of the receptacle partially broken away to further detail the post and spring biasing mechanism.
Figure 6:
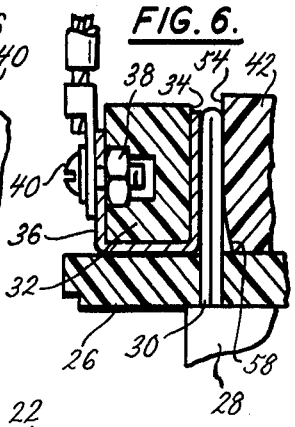
FIG. 6 is a cross-sectional view taken along the plane of line 6—6 in FIG. 3 which details the stationary terminal of the receptacle.
Figure 4:
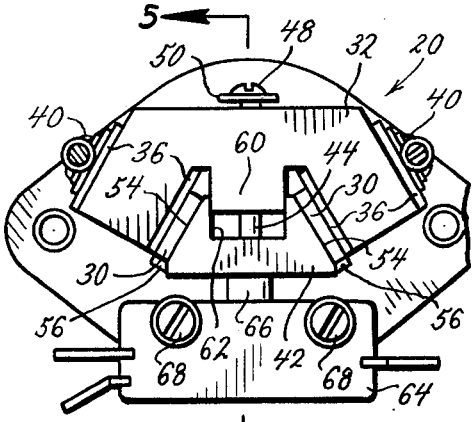
FIG. 4 is a rear view of the receptacle detailing the back body member, contact pressure element and snap switch.
Figure 3:
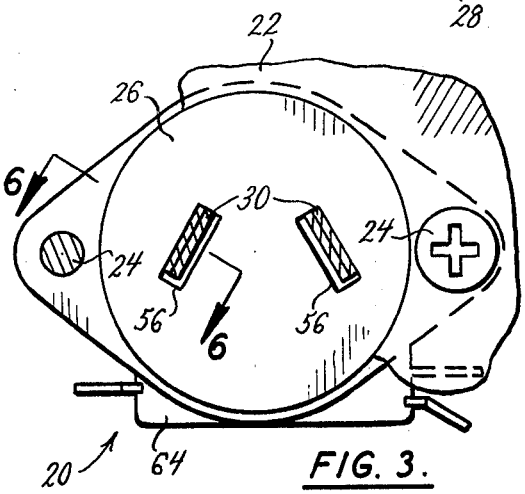
FIG. 3 is a cross-sectional view taken along the plane of line 3—3 in FIG. 1 and which details the face of the receptacle.
Figure 2:
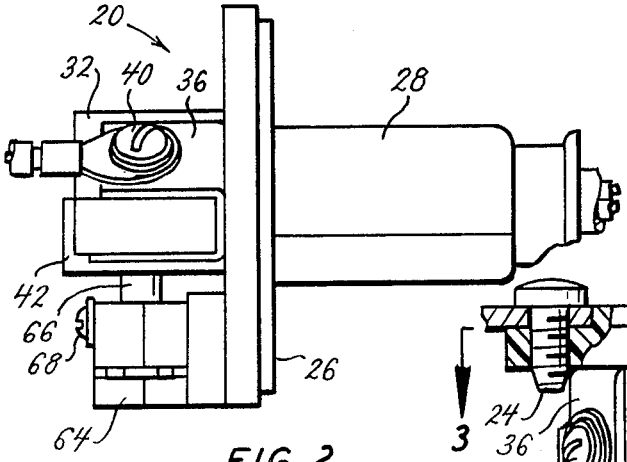
FIG. 2 is a side elevation view of the receptacle and plug.
Figure 1:
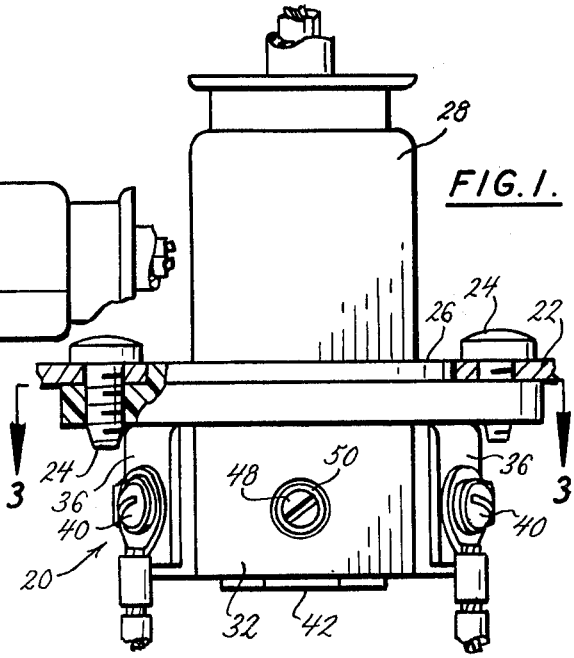
FIG. 1 is a top view of the invention of a receptacle with a matching plug inserted therein.

The receptacle 20 of the present invention may be flush mounted to a panel 22 by a pair of screws 24 such that the face 26 is the only exposed portion thereof. A plug 28 having a pair of blades 30 is shown inserted into the receptacle 20 in FIGS. 1–6. The receptacle 20 has a back body member 32 which may be integrally molded with the face 26 in a suitable manner such as by injection molding to decrease cost. Slots 34 are formed on either side of the back body member 32, and between back body member 32 and the back of face 26 to permit the sliding insertion of a U-shaped terminal bracket 36 which may be secured by a captured nut 38 and bolt 40 as is best shown in FIGS. 6 and 7. A contact pressure element 42 is spring loaded from the back body member 32 by a post or stem 44 having a head 46 with a bolt 48 and washer 50 compressing a spring 52. This is best shown in FIGS. 5 and 7. The contact pressure element has a flattened surface 54 on opposite sides thereof which match and align with the blade openings 56 and terminal brackets 36. The leading edge 58 of contact pressure element 42 is slightly beveled as is best shown in FIG. 6 to facilitate the separation of contact pressure element 42 from terminal bracket 36 as blade 30 is inserted therein. Back body member 32 has a center guide platform 60 which projects downwardly between blade openings 56 which matches and lines up with a center guide notch 62 in contact pressure element 42. Thus, the contact pressure element 42 is centered and aligned as it deflects upon insertion or removal of blades 30. A snap switch 64 having a push button operator 66 may be mounted to the back of face 26 by bolts 68 and aligned such that the post head 46 operates it as the blades 30 are inserted in blade openings 56. This is best shown in FIG. 5. Thus, depending upon the circuitry of snap switch 64, an electrical circuit may be operated upon either insertion or removal of blades 30 to indicate the connection or disconnection of same.

Various changes and modifications to the invention would be apparent to one of ordinary skill in the art. These changes and modifications are included within the scope of the present invention which is intended to be limited only by the scope of the claims appended hereto.

What is claimed is:

1. An electrical receptacle having means defining at least one blade opening for receiving the blades of an electrical plug, said receptacle having stationary electrical contact surfaces extending at least partially along the length of each blade opening, a movable contact pressure element having at least one flattened surface for juxtaposition with each said stationary contact surface, a post extending between the contact pressure element and the receptacle, and a spring surrounding said post and compressed between the post and the receptacle to bias said movable contact pressure element so that said flattened surfaces are urged against the electrical contact surfaces and movement of the contact pressure element away from the blade openings further compresses the spring.

2. The receptacle of claim 1 further comprising an electrical snap switch mounted adjacent the movable contact pressure element so that insertion or removal of an electrical plug from the receptacle actuates said snap switch.

3. The receptacle of claim 2 wherein the post has a head, the electrical snap switch having a push button operator and mounted to the receptacle so that said post head is aligned with said push button operator to operate same.

4. An electrical receptacle having means defining two blade openings for receiving the blades of an electrical plug, said blade openings oriented to lie along the sides of a triangle, the receptacle having stationary electrical contact surfaces extending at least partially along the length of each blade opening, a back body member with a center guide platform extending between said blade openings, a movable contact pressure element having at least one flattened surface for juxtaposition with each said stationary contact surface and a center guide notch to match and line up with said center guide platform, and means to bias said movable contact pressure element so that said flattened surfaces are urged against the electrical contact surfaces.

5. The receptacle of claim 4 wherein said biasing means includes a post slidably extending through said center guide platform and contact pressure element and a spring surrounding the post and compressed between the post and the back body member so that movement of the contact pressure element away from the blade openings is resisted by the spring.

6. The receptacle of claim 5 wherein the post has a head, and further comprising an electrical snap switch having a push button operator and mounted to the receptacle adjacent the movable contact pressure element so that said post is aligned with and operates said push button operator upon insertion or removal of an electrical plug from the receptacle.

7. The receptacle of claim 4 wherein the stationary electrical contact surfaces are each mounted to the back body by a screw.

8. The receptacle of claim 4 wherein the pressure of the contact pressure element against each blade causes it to wipe against its associated stationary electrical contact surface as the blade is inserted or removed from the blade opening.

9. The receptacle of claim 4 further comprising an electrical snap switch mounted adjacent the movable contact pressure element so that insertion or removal of the electrical plug from the receptacle actuates said snap switch.

* * * * *